US006991487B2

(12) United States Patent
Wu

(10) Patent No.: US 6,991,487 B2
(45) Date of Patent: Jan. 31, 2006

(54) CABLE END CONNECTOR ASSEMBLY HAVING LOCKING MEMBER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/787,661

(22) Filed: Feb. 25, 2004

(65) Prior Publication Data

US 2005/0186830 A1 Aug. 25, 2005

(51) Int. Cl.
*H01R 13/627* (2006.01)

(52) U.S. Cl. ..... 439/358; 439/355

(58) Field of Classification Search ..... 439/351–358
See application file for complete search history.

(56) References Cited

U.S. PATENT DOCUMENTS

| | | | | |
|---|---|---|---|---|
| 5,213,533 | A | 5/1993 | Walden | |
| 5,727,963 | A | 3/1998 | LeMaster | |
| 5,775,931 | A | 7/1998 | Jones | |
| 5,860,826 | A | 1/1999 | Chang | |
| 5,941,726 | A | 8/1999 | Koegel et al. | |
| 6,099,339 | A * | 8/2000 | Yanagida et al. | 439/358 |
| 6,210,202 | B1 | 4/2001 | Kuo | |
| 6,361,363 | B1 * | 3/2002 | Hwang | 439/555 |
| 6,558,183 | B1 | 5/2003 | Ji et al. | |
| 6,565,383 | B1 | 5/2003 | Wu | |
| 6,585,536 | B1 | 7/2003 | Wu | |
| 6,585,537 | B1 | 7/2003 | Lee | |
| 6,786,755 | B2 * | 9/2004 | Dambach et al. | 439/353 |
| 6,863,546 | B2 * | 3/2005 | Yang et al. | 439/79 |

* cited by examiner

*Primary Examiner*—Chandrika Prasad
(74) *Attorney, Agent, or Firm*—Wei Te Chung

(57) ABSTRACT

A cable end connector assembly (1) has an insulative housing (10), a number of contacts (20) received in the insulative housing, a number of cables (40) electrically connecting with corresponding contacts, a cover (50) over-molded with the insulative housing and the cables, and a pair of locking members (60). Each locking member includes at one end thereof a housing retention section (62) retained in the housing, a cover retention section (61) extending from the housing retention section and retained in the cover, a spring section (63) extending from the cover retention section, a pushing section (64) extending outside from the spring section, and a latch section (66) at another end thereof for locking with a complementary connector.

16 Claims, 13 Drawing Sheets

CABLE END CONNECTOR ASSEMBLY HAVING LOCKING MEMBER

BACKGROUND OF THE INVENTION

1. Field of the Invention

The present invention relates to a cable end connector assembly, and particularly to a cable end connector assembly having a locking member for locking with a complementary connector.

2. Description of Prior Arts

There exists in the art a cable end connector assembly known as a Serial Advanced Technology Attachment (Serial ATA) connector which is generally used for disk drives and storage peripherals. Especially, the Serial ATA connectors according to the Serial ATA standard are featured in fewer electrical contacts than other conventional electrical connectors and are relatively tiny in configuration. It is desirable for the Serial ATA connector to have latch means for providing a reliable mechanical and electrical connection with a complementary connector. U.S. Pat. Nos. 6,565,383 and 6,585,536, having the same inventor and the same assignee with the present invention, each disclose a Serial ATA connector equipped with a locking member for locking with a complementary connector. The locking member comprises a middle portion retained on a connector housing, a pushing portion extending rearwardly from the middle portion, and a locking tab extending forwardly from the middle portion for locking/releasing the Serial ATA connector with/from the complementary connector.

With the developing of the Serial ATA standard, the next-generation serial storage interface effort expands the base Serial ATA 1.0 capabilities to address additional markets segments, including the server and networked storage markets. A cable end connector assembly based on Serial ATA II standard is designed to connect with more devices and cables. As the connector is probably applied to a wider profile, the locking member of the Serial ATA connector disclosed in the above-mentioned patent is not fitable.

Hence, a cable end connector assembly having an improved locking member is desired.

SUMMARY OF THE INVENTION

An object of the present invention is to provide a cable end connector assembly having an improved locking member for locking the cable end connector assembly with a complementary connector.

To achieve the above object, a cable end connector assembly in accordance with the present invention comprises an insulative housing, a plurality of contacts received in the insulative housing, a plurality of cables comprising a plurality of conductors electrically connecting with corresponding contacts, a cover over-molded with the insulative housing, and the cables, and a pair of locking members. Each locking member comprises at one end thereof a housing retention section retaining in the housing, a cover retention section extending from the housing retention section and retaining in the cover, a spring section extending from the cover retention section, a pushing section extending outside from the spring section and a latch section at another end thereof for locking with a complementary connector.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
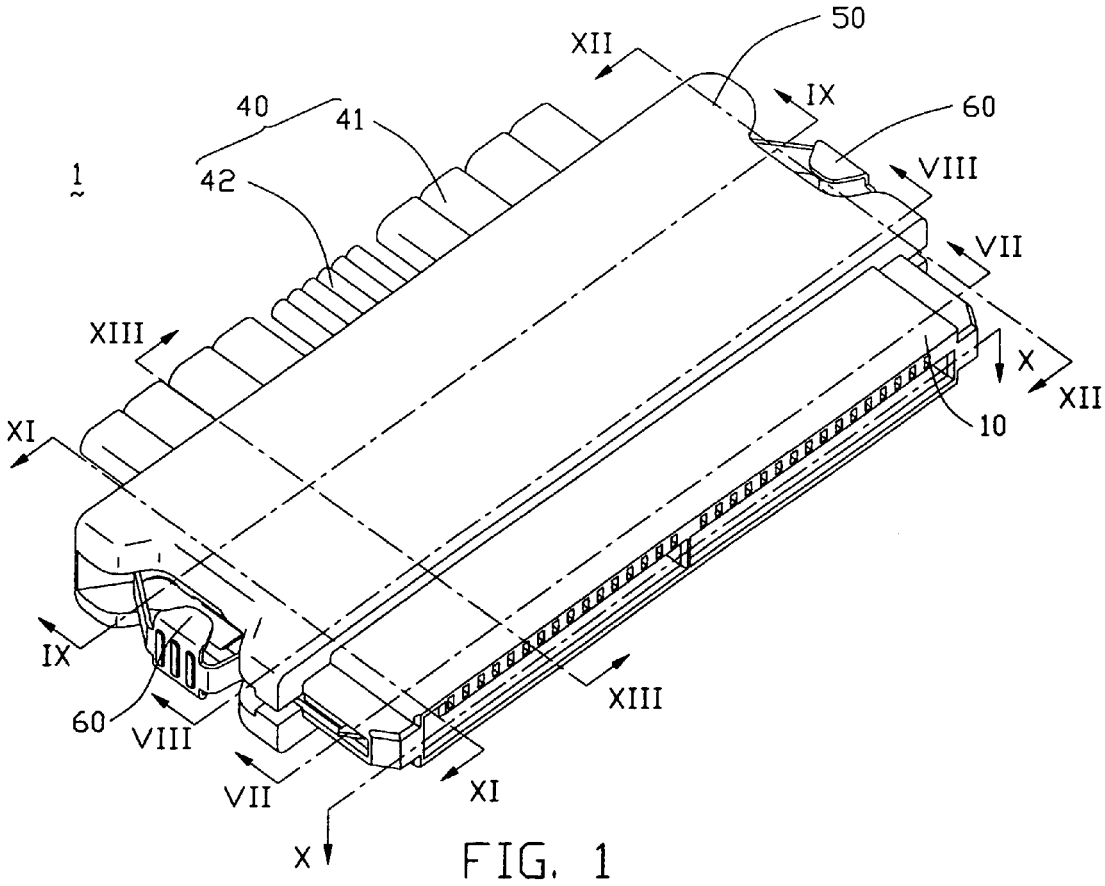
FIG. 1 is a perspective view of a cable end connector assembly in accordance with the present invention.
Figure 2:
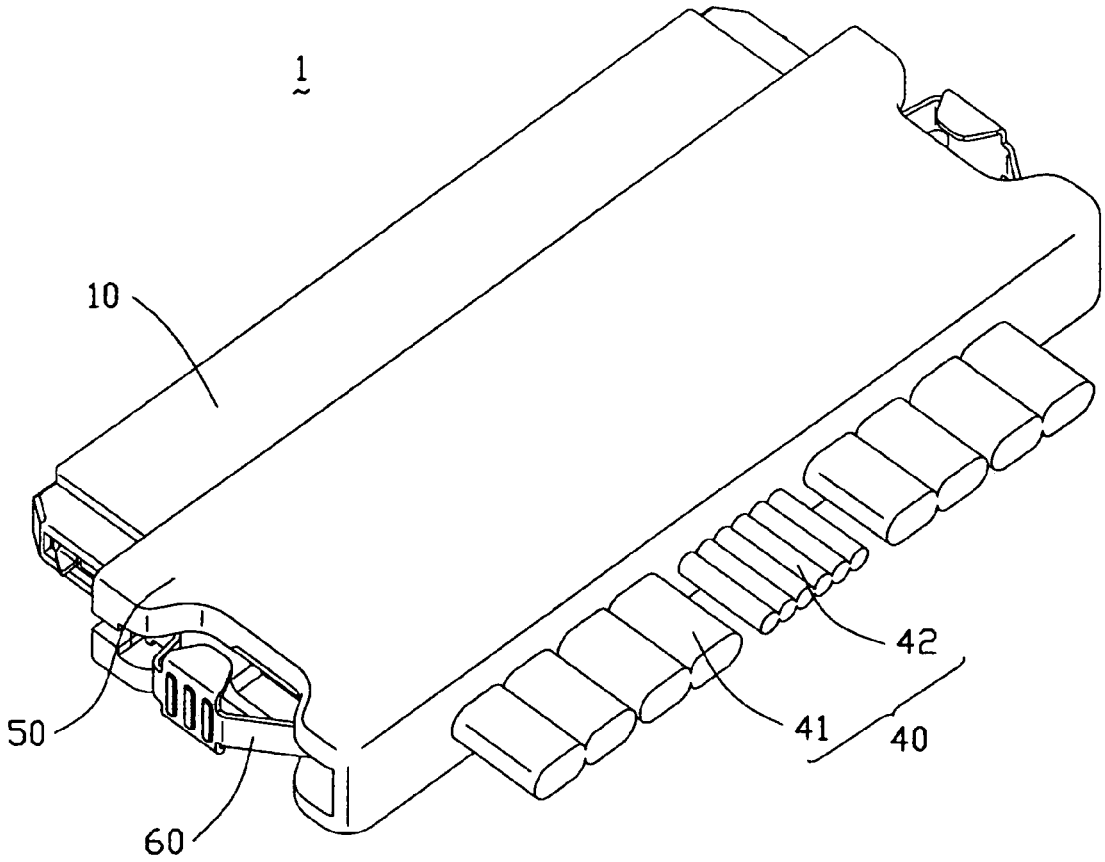
FIG. 2 is a view similar to FIG. 1, but taken from a different aspect.

Referring to FIGS. 1 to 4, a cable end connector assembly 1 in accordance with the present invention comprises an insulative housing 10, a plurality of contacts 20, a spacer 30, a plurality of cables 40, a cover 50 and a pair of locking members 60. In a preferred embodiment, the cable end connector assembly 1 is typical a Serial ATA II connector. However, in alternative embodiments, the electrical connector could be provided as other types.

Figure 3:
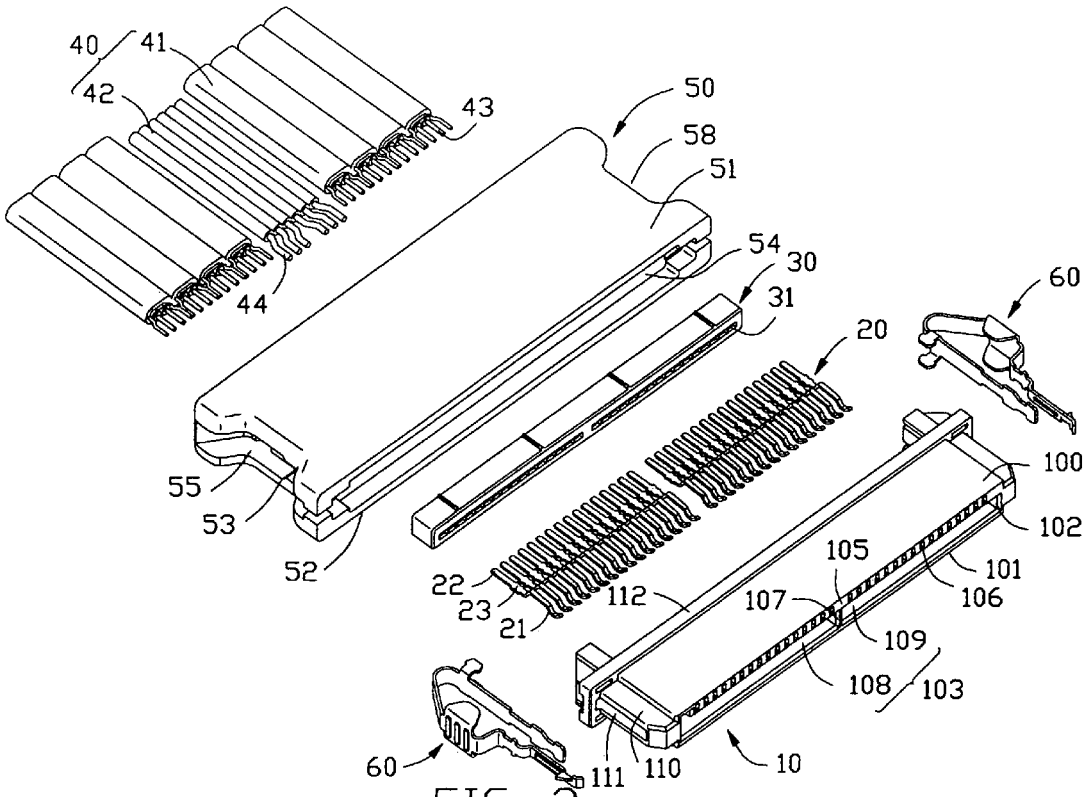
FIG. 3 is an exploded, perspective view of the cable end connector assembly of FIG. 1.
Figure 4:
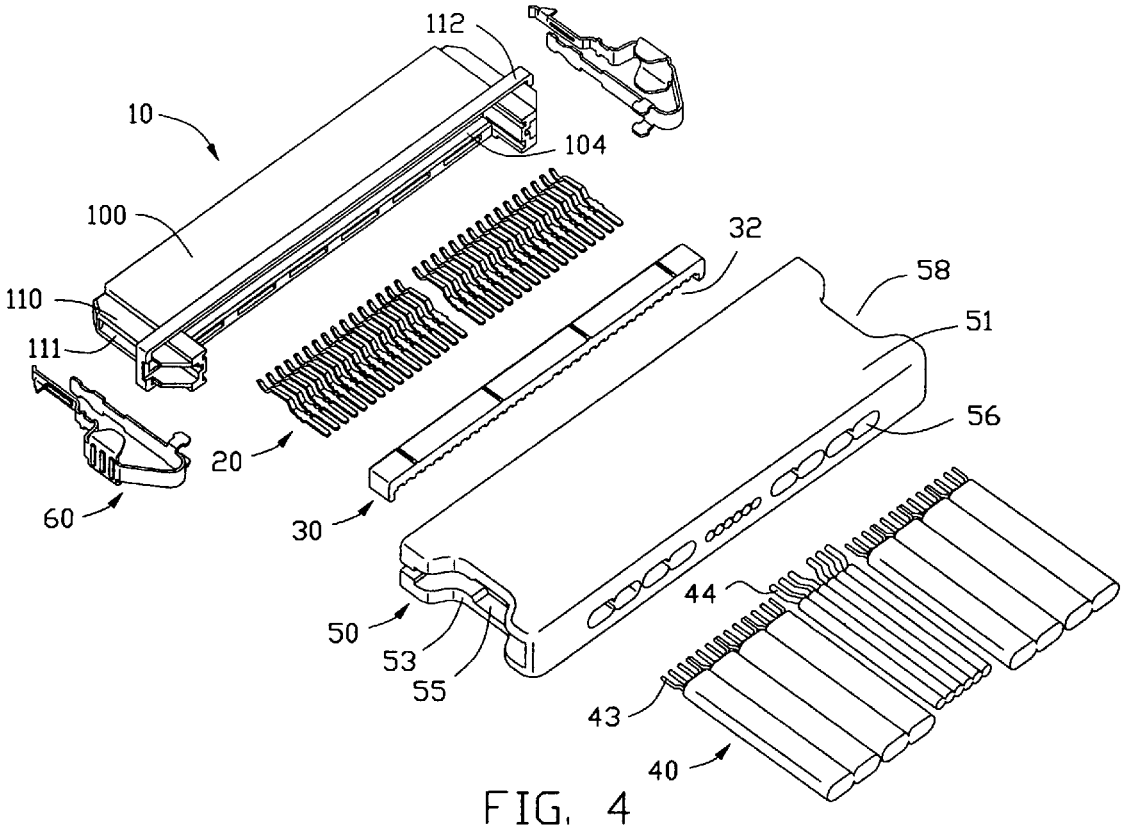
FIG. 4 is a view similar to FIG. 3, but taken from a different aspect.

Particularly referring to FIGS. 3 and 4, the insulative housing 10 comprises an upper wall 100, a lower wall 101 opposite to the upper wall 100, and a pair of side portions 102 connecting with the upper wall 100 and the lower wall 101. The insulative housing 10 further comprises a front end (not labeled) and a rear end (not labeled) opposite to the front end. Between the upper and the lower walls 100, 101, the housing 10 defines a plug receiving space 103 and a spacer receiving space 104 for respectively receiving a complementary connector (not shown) and the spacer 30. The plug receiving space 103 extends from the front end of the housing 10 towards the rear end of the housing 10 and communicates with the spacer receiving space 104. A block 105 is formed on the upper wall 100 and protrudes into the plug receiving space 103. The block 105 defines a plurality of passageways 106 extending therethrough and communicating with the plug receiving space 103 and the spacer receiving space 104. The plug receiving space 103 is divided into an L-shaped first port 108 and a rectangular second port 109 by a vertically extended partition wall 107 for receiving complementary connectors with different profiles. Each side portion 102 defines a retention cavity 111 therein for engaging the locking member 60. A baffle 112 is provided on the upper and lower walls 100, 101 and adjacent to the rear end of the insulative housing 10.

Figure 13:
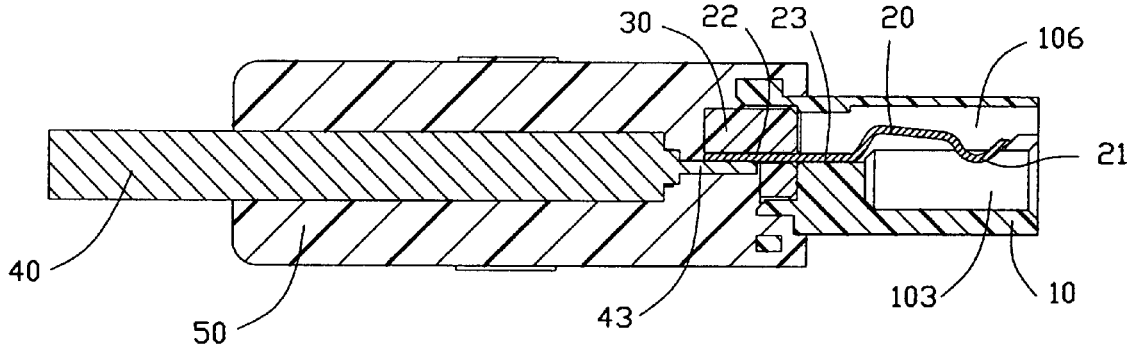
FIG. 13 is a cross-sectional view taken along line XII-I–XIII of FIG. 1.

Referring to FIGS. 3, 4 and 13, the contacts 20 are received in the passageways 106 of the insulative housing 10 and each contact comprises a contact portion 21, a tail portion 22 and a housing retaining portion 23 connecting the contact portion 21 and the tail portion 22. The contact portions 21 extend into the L-shaped first port 108 and the rectangular second port 109 of the plug receiving space 103 of the housing 10, respectively. The housing retaining portions 23 are secured within the passageways 106 of the housing 10 by an interference fit. The spacer 30 is mounted to a rear end of the insulative housing 10, and comprises a plurality of through holes 31 for allowing the tail portions 21 of the contacts 20 extending therethrough. The spacer 30 can prevent plastic from entering into the passageways 105 of the insulative housing 10 during the molding of the cover 50. The contacts 20 and the spacer 30 can be integrally formed before mounting to the insulative housing 10, if desired.

The cables 40 comprise a pair of first 4-lane cables 41 and a second flat ribbon cable 42 located between the 4-lane cables. The second cable 42 is divided into two groups. The first cable 41 and the second cable 42 are respectively designed to transit high-speed signal and low-speed sideband signal. Each cable 40 comprises a plurality of conductors 43,44 exposed outside and extending towards the spacer 30 for soldering to corresponding tail portions 22 of the contacts 20.

The cover 50 is over-molded with the rear end of the insulative housing 10, the spacer 30 and the cables 40, and comprises an upper plate 51, a lower plate 52 opposite to the upper plate 51, and a pair of side portions 53 connecting with the upper plate 51 and the lower plate 52. A receiving cavity 54 is defined inwardly between the upper and the lower plates 51, 52 for receiving the insulative housing 10, the spacer 30 and the cable 40. Each side portion 53 comprises a depression 58 and a retention cavity 55 communicating with the retention cavity 110 of the housing 10 for receiving the locking member 60. A plurality of channels 56 are defined on a rear face of the cover 50 for allowing the cables 40 extending therethrough.

Figure 5:
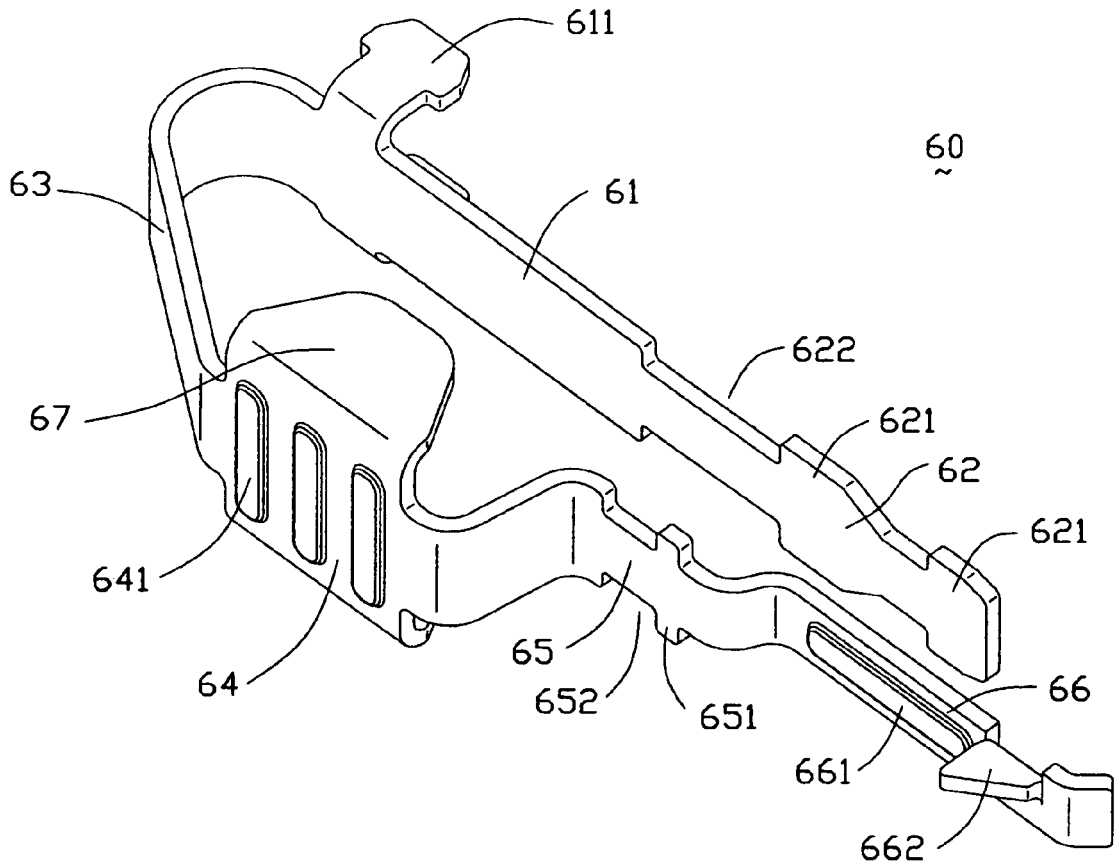
FIG. 5 is an enlarged view of a locking member shown in FIG. 3.
Figure 6:
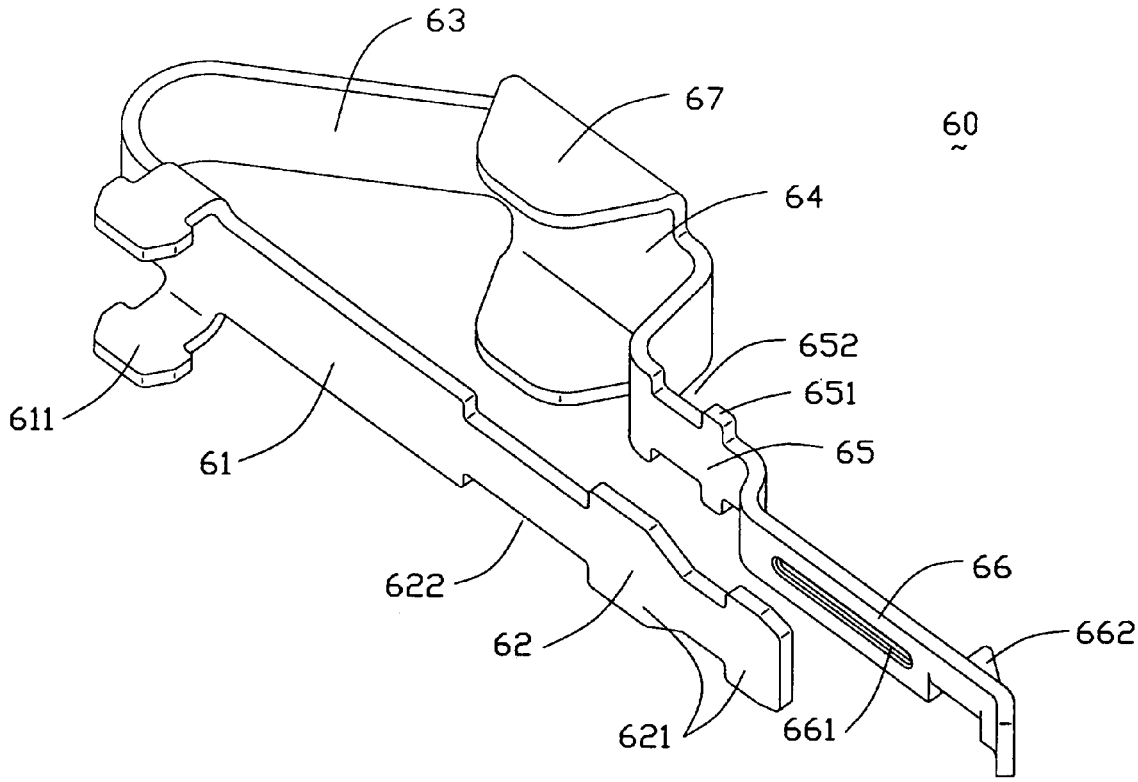
FIG. 6 is a view similar to FIG. 5, but taken from a different aspect.
Figure 7:
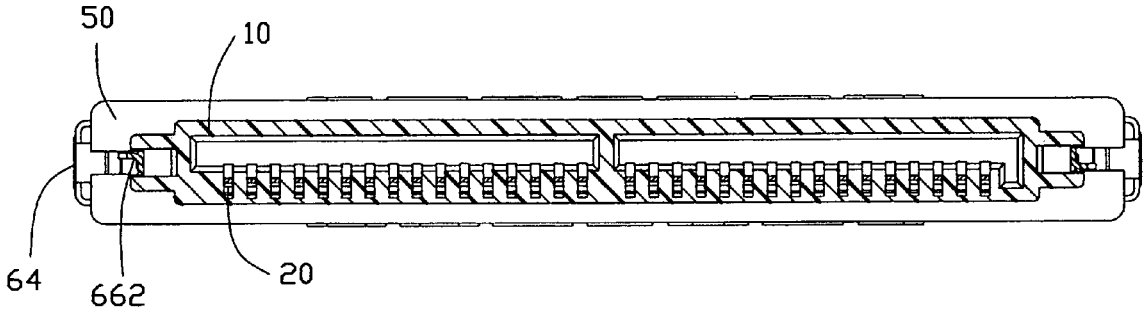
FIG. 7 is a cross-sectional view taken along line VII–VII of FIG. 1.
Figure 8:
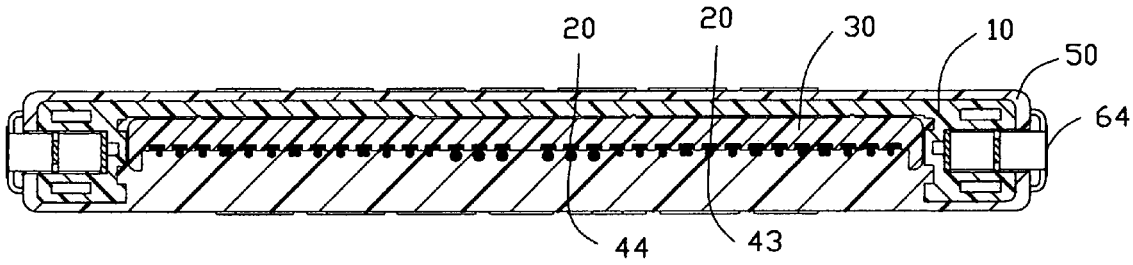
FIG. 8 is a cross-sectional view taken along line VIII–VIII of FIG. 1.
Figure 9:
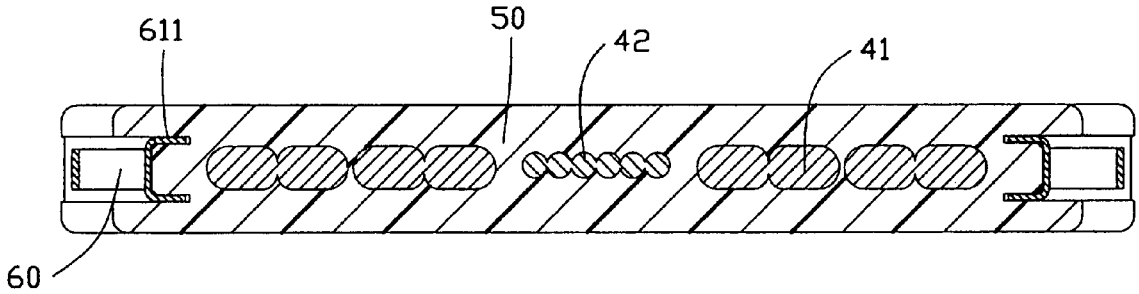
FIG. 9 is a cross-sectional view taken along line IX–IX of FIG. 1.
Figure 10:
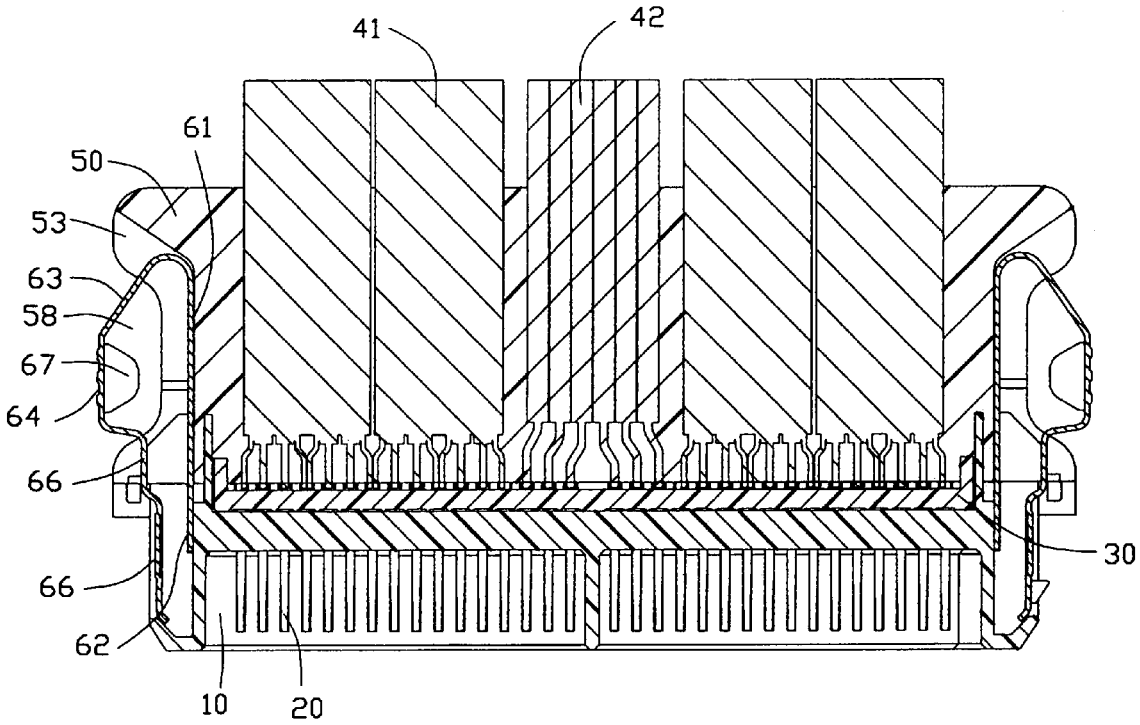
FIG. 10 is a cross-sectional view taken along line X–X of FIG. 1.
Figure 11:
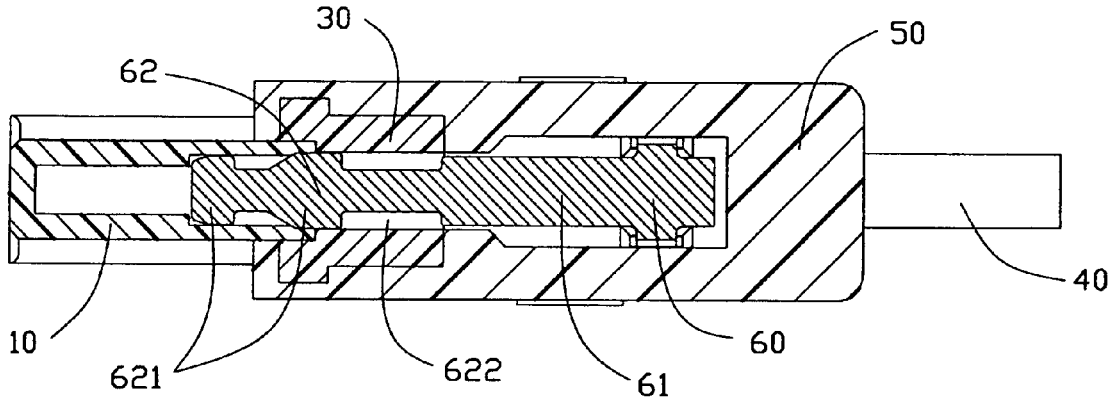
FIG. 11 is a cross-sectional view taken along line XI–XI of FIG. 1.
Figure 12:
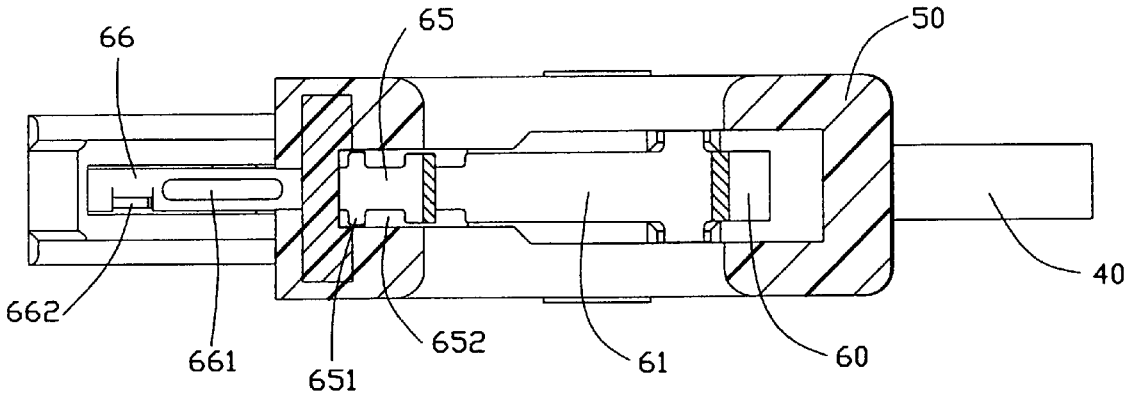
FIG. 12 is a cross-sectional view taken along line XII–XII of FIG. 1.

Referring to FIGS. 5 and 6, each locking member 60 is stamped and formed from a metallic plate and comprising an elongate, housing retention section 62 extending along a front-to-back direction, a cover retention section 61 extending rearwardly from the housing retention section 62, a spring section 63 extending slantways from the cover retention section 61, a flat pushing section 64 extending forwardly from the spring section 63, an L-shaped positioning section 65 extending forwardly from the pushing section 64, and a latch section 66 extending forwardly from the positioning section 65. The housing retention section 62 comprises a pair of retention tabs 621 protruding therefrom and a pair of recesses 622. The cover retention section 61 defines a pair of retention tabs 611 extending into the cover 50. The pushing section 64 defines a plurality of protrusions 641 for handling. A pair of stopping section 67 extend towards the cover 50 from opposite sides of the pushing section 64. The positioning section 65 comprises a pair of positioning tabs 651 and a pair of recesses 652 for assuring fixed assembly. The latch section 66 extends along a same direction to and projects beyond the housing retention section, and comprises a protrusion 661 and a locking tab 662 bent and extending outwardly.

Referring to FIGS. 7 to 12, in assembly, the housing retention section 62 is received in the retention cavity 111 of the housing 10 with the retention tabs 621 being interfered therein. The cover retention section 61 received in the retention cavity 55 of the cover 50 with the retention tabs 61 extending to and securely retained in the cover 50. The pushing section 64 and the stopping section 67 are located in the depression 58 of the cover 50, and the stopping section 67 extends towards the cover 50. The latch section 66 is received in the retention cavity 111 of the housing 10 and the locking tab 662 projects outside the housing 10. When the cable end connector assembly 1 mates with the complementary connector, a pressing force is firstly exerted on the pushing section 64 of each locking member 60 to drive the latch section 66 move inwardly. The stopping section 67 abuts against the side portion 53 of the cover 50 to prevent an immoderate deflection of the latch section 66. Once the pressing force is released, the latch section 66 restore to its original position due to their own elasticity and thus locks with the complementary connector through the locking tab 662. The positioning tabs 651 of the positioning section 65 abut against the baffle 112 of the housing for assuring a reliable mating between the cable end connector assembly 1 and the complementary connector. When the cable end connector assembly 1 is to be disengaged from the complementary connector, a contrary operating procedure is applied.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable end connector assembly for mating with a complementary connector, comprising:

an insulative housing comprising a pair of opposite side portions and a rear end, each side portion defining a retention cavity;

a plurality of contacts received in the insulative housing;

a plurality of cables comprising a plurality of conductors electrically connecting with corresponding contacts;

a cover enclosing the rear end of the insulative housing and defining a pair of side portion, each side portion comprising a retention cavity communicating with the retention cavity of the housing; and a pair of locking members received in the retention cavities of the housing and the cover, each locking member comprising at one end thereof a housing retention section retaining in the housing, a cover retention section extending from the housing retention section and retaining in the cover, a spring section extending from the cover retention section, a pushing section extending outside from the spring section and a latch section at another end thereof for locking with a complementary connector.

2. The cable end connector assembly as described in claim 1, wherein each locking member comprises a positioning section connecting the latch section and the pushing section, the positioning section defines a pair of positioning tabs on opposite sides thereof abutting against the housing when the complementary connector is unmated from the cable end connector without a pressing force exerting on the pushing section.

3. The cable end connector assembly as described in claim 2, wherein each locking member copses a pair of stopping sections extending from opposite sides of the pushing section towards the cover, the stopping section abuts against the cover when the locking section is exerted to deflect.

4. The cable end connector assembly as described in claim 3, wherein the housing retention section comprises a pair of retention tabs secured with the housing and a pair of recesses for assuring fixed assembly.

5. The cable end connector assembly as described in claim 4, wherein the cover retention section defines a pair of retention tabs extending vertically to the retention tabs of the housing retention section and secured with the cover.

6. The cable end connector assembly as described in claim 5, the positioning section comprises on opposite side thereof a pair of positioning tabs and a pair of recesses for assuring fixed assembly.

7. The cable end connector assembly as described in claim 6, wherein the cover defines a depression communicating with the retention cavity of the cover, the pushing section and the stopping section is located in the depression.

8. The cable end connector assembly as described in claim 7, wherein the cables comprise at least one first cable and at least one second cable respectively transmitting different signals.

9. The cable end connector assembly as described in claim 1, further comprising a spacer mounted on the rear end of the housing.

10. The cable end connector assembly as described in claim 1, wherein the housing defines a receiving space therein and a partition wall extending along a longitudinal direction, the receiving space is divided by a partition wall into two ports.

11. The cable end connector assembly as described in claim 10, wherein one of the two ports of the housing is L-shaped.

12. A cable end connector assembly comprising:

an insulative housing defining a forwardly extending mating port with a pair of opposite side portions by two sides thereof, each of said side portions defining a first retention cavity;

a plurality of contacts disposed in the housing;

a plurality of rearwardly extending cables including a plurality of conductors connected to a rear portion of the housing;

a cover molded over the housing and front portions of the cables, and defining a pair of opposite side portions with a pair of second retention cavities therein, respectively, the first cavities aligned with the corresponding second retention cavities in a front-to-back direction, respectively; and a pair of locking members each disposed in the corresponding aligned first and second retention cavities, and including an inner housing retention section and an inner cover retention section respectively retained to the first retention cavity and the second retention cavity, an outer arm laterally moveable relative to the housing retention section and the cover retention section in a lateral direction perpendicular to said front-to-back direction, a latch section located at a front end of the outer operation arm; wherein at least one of said housing and said cover provides a restraint portion located outside of the outer arm in said lateral direction for prohibiting excessive outwardly lateral movement of said outer arm.

13. The assembly as described in claim 12, wherein said outer arm includes an inwardly extending stopping section for prohibiting excessive inwardly lateral movement of the outer arm.

14. The assembly as described in claim 12, wherein the outer arm further includes a positioning section for assuring correct movement of the outer arm in said first retention cavity.

15. The assembly as described in claim 12, wherein said housing retention section and said cover retention section are aligned with each other said front-to-back direction.

16. A method of making a cable end connector assembly, comprising steps of:

providing an insulative housing with a pair of opposite side portions defining a pair of first retention cavities therein, respectively;

assembling a plurality of contacts into the housing;

connecting a plurality of cables to the corresponding contacts, respectively, at a rear portion of the housing;

applying a cover over the rear portion of the housing, and front portions of the cables by an over-molding process under a condition that a pair of second retention cavities formed in two opposite side portions of the cover wherein the pair of first retention cavities are aligned with the pair of second retention cavities, respectively, in a front-to-back direction; and assembling a pair of locking members to the assembled cover and housing from both opposite sides under a condition that each of said locking members is assembled initially in an inward direction and successively in a forward direction until an inner arm of the locking member is attached to the corresponding first and second retention cavities, and an outer arm of the locking member is restrainedly received in the corresponding first and second retention cavities under a condition at least one of the cover and the housing provides means for prohibiting excessive outward movement of the outer arm.

* * * * *